US010407276B2

(12) United States Patent
Honda et al.

(10) Patent No.: US 10,407,276 B2
(45) Date of Patent: Sep. 10, 2019

(54) ELEVATOR DEVICE

(71) Applicant: Mitsubishi Electric Corporation, Chiyoda-ku (JP)

(72) Inventors: Chiaki Honda, Tokyo (JP); Masashi Komatsu, Veenendaal (NL); Ashiqur Rahman, Veenendaal (NL); David Willem Lodewijk Offerhaus, Veenendaal (NL); Takaharu Ueda, Tokyo (JP); Shinichi Kuroda, Tokyo (JP); Koji Yamagishi, Tokyo (JP); Kenji Taniyama, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 127 days.

(21) Appl. No.: 15/513,645

(22) PCT Filed: Sep. 24, 2014

(86) PCT No.: PCT/JP2014/075262
§ 371 (c)(1),
(2) Date: Mar. 23, 2017

(87) PCT Pub. No.: WO2016/046916
PCT Pub. Date: Mar. 31, 2016

(65) Prior Publication Data

US 2017/0305717 A1 Oct. 26, 2017

(51) Int. Cl.
*B66B 5/02* (2006.01)
*B66B 3/00* (2006.01)

(52) U.S. Cl.
CPC ..... *B66B 5/02* (2013.01); *B66B 3/002* (2013.01); *B66B 3/004* (2013.01); *B66B 5/024* (2013.01)

(58) Field of Classification Search
CPC ..... B66B 5/02
(Continued)

(56) References Cited

U.S. PATENT DOCUMENTS 5,693,919 A * 12/1997 Sager ..... B66B 5/027 187/282
5,979,607 A * 11/1999 Allen ..... B66B 5/024 187/384

(Continued)

FOREIGN PATENT DOCUMENTS

| | | | |
|---|---|---|---|
| EP | 2 727 874 | A1 | 5/2014 |
| JP | 2003-276964 | A | 10/2003 |
| WO | 2013/001643 | A1 | 1/2013 |

OTHER PUBLICATIONS

International Preliminary Report on Patentability and Written Opinion dated Apr. 6, 2017 in PCT/JP2014/075262 (submitting English translation only).

(Continued)

*Primary Examiner* — David S Warren
(74) *Attorney, Agent, or Firm* — Oblon, McClelland, Maier & Neustadt, L.L.P.

(57) ABSTRACT

An elevator device that can continuously evacuate any evacuee left in a building by using an elevator. The elevator device includes a control device configured to maintain an evacuation operation mode corresponding to a rescue floor concerned when a car operation instructing device is operated on the rescue floor concerned before a predetermined time passes from when the car stops at the rescue floor concerned during the evacuation operation mode corresponding to the rescue floor concerned, and release the evacuation operation mode corresponding to the rescue floor concerned when the car operation instructing device is not operated on the rescue floor concerned before the predetermined time passes from when the car stops at the rescue (Continued)

S1 DETECT OPERATION ON EVACUATION OPERATION MODE REQUESTING DEVICE
S2 IS EVACUATION OPERATION MODE REQUESTING DEVICE ON ANOTHER RESCUE FLOOR ALREADY OPERATED?
S3 APPOINT EVACUATION OPERATION MODE (CORRESPONDING TO RESCUE FLOOR CONCERNED), AND TURN ON ILLUMINATION DEVICE
S4 SET RESCUE FLOOR CONCERNED AS SELECTED RESCUE FLOOR
S5 MOVE CAR TO SELECTED RESCUE FLOOR AND OPEN DOORS
S6 HAS JUDGMENT TIME PASSED?
S7 IS CAR OPERATION INSTRUCTING DEVICE OPERATED?
S8 START CLOSING DOORS
S9 IS CAR OPERATION INSTRUCTING DEVICE OPERATED AGAIN BEFORE DOORS ARE FULLY CLOSED?
S10 PERFORM DOOR REVERSAL TO OPEN DOORS
S11 MOVE CAR EVACUATION FLOOR, OPENS DOORS AND THEN CLOSE DOORS
S12 IS EVACUATION OPERATION MODE REQUESTING DEVICE IN OPERATED STATE?
S13 IS EVACUATION OPERATION MODE APPOINTED?
S14 SET ANOTHER RESCUE FLOOR AS SELECTED RESCUE FLOOR
S15 END EVACUATION OPERATION MODE
S16 ACTIVATE NOTIFICATION DEVICE
S17 IS CAR OPERATION INSTRUCTING DEVICE OPERATED?
S18 CLOSE DOORS, MOVE CAR TO EVACUATION FLOOR, AND OPEN DOORS floor concerned during the evacuation operation mode corresponding to the rescue floor concerned.

7 Claims, 7 Drawing Sheets

(58) Field of Classification Search
USPC ..... 187/247
See application file for complete search history.

(56) References Cited

U.S. PATENT DOCUMENTS 6,000,505 A * 12/1999 Allen ..... B66B 5/024 187/247
7,621,378 B2 * 11/2009 Kawai ..... B66B 5/024 187/313
7,677,363 B2 * 3/2010 Kawai ..... B66B 5/021 187/313
7,938,232 B2 * 5/2011 Hikita ..... B66B 5/024 187/313
8,763,761 B2 * 7/2014 Siikonen ..... B66B 5/021 187/384
8,839,914 B2 * 9/2014 Iwata ..... B66B 5/024 187/384
2007/0272497 A1 * 11/2007 Kawai ..... B66B 5/021 187/393
2009/0038891 A1 * 2/2009 Kawai ..... B66B 5/021 187/247
2010/0224451 A1 * 9/2010 Hikita ..... B66B 5/024 187/247
2017/0305717 A1 * 10/2017 Honda ..... B66B 5/02

OTHER PUBLICATIONS

International Search Report dated Jan. 6, 2015 in PCT/JP2014/075262 filed Sep. 24, 2014.

* cited by examiner

*FIG. 7*

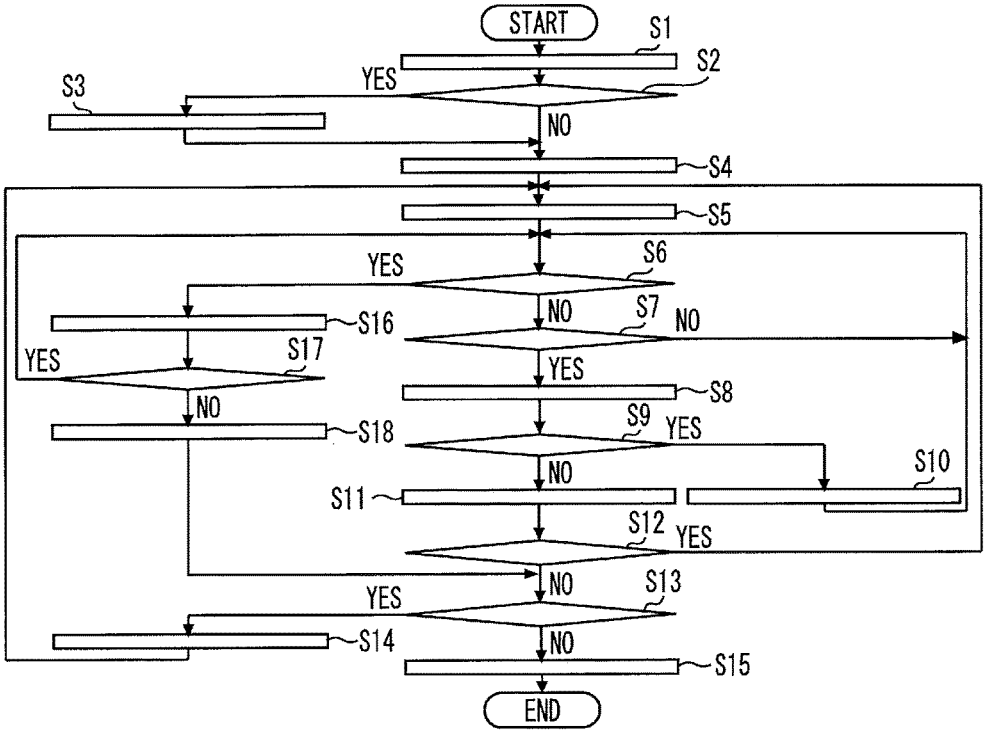

S1 DETECT OPERATION ON EVACUATION OPERATION MODE REQUESTING DEVICE
S2 IS EVACUATION OPERATION MODE REQUESTING DEVICE ON ANOTHER RESCUE FLOOR ALREADY OPERATED?
S3 APPOINT EVACUATION OPERATION MODE CORRESPONDING TO RESCUE FLOOR CONCERNED, AND TURN ON ILLUMINATION DEVICE
S4 SET RESCUE FLOOR CONCERNED AS SELECTED RESCUE FLOOR
S5 MOVE CAR TO SELECTED RESCUE FLOOR AND OPEN DOORS
S6 HAS JUDGMENT TIME PASSED?
S7 IS CAR OPERATION INSTRUCTING DEVICE OPERATED?
S8 START CLOSING DOORS
S9 IS CAR OPERATION INSTRUCTING DEVICE OPERATED AGAIN BEFORE DOORS ARE FULLY CLOSED?
S10 PERFORM DOOR REVERSAL TO OPEN DOORS
S11 MOVE CAR EVACUATION FLOOR, OPENS DOORS AND THEN CLOSE DOORS
S12 IS EVACUATION OPERATION MODE REQUESTING DEVICE IN OPERATED STATE?
S13 IS EVACUATION OPERATION MODE APPOINTED?
S14 SET ANOTHER RESCUE FLOOR AS SELECTED RESCUE FLOOR
S15 END EVACUATION OPERATION MODE
S16 ACTIVATE NOTIFICATION DEVICE
S17 IS CAR OPERATION INSTRUCTING DEVICE OPERATED?
S18 CLOSE DOORS, MOVE CAR TO EVACUATION FLOOR, AND OPEN DOORS

ELEVATOR DEVICE

FIELD

The present invention relates to an elevator device.

BACKGROUND

PTL 1 discloses an elevator device. On this elevator device, setting of rescue floors and evacuation floors is made. An evacuation operation mode requesting device is provided on each rescue floor. When a disaster such as fire occurs, an evacuation guide operates the evacuation operation mode requesting device. When the evacuation operation mode requesting device is maintained in an operated state, a car maintains its operation in an evacuation operation mode. In the evacuation operation mode, the car travels between a rescue floor concerned and an evacuation floor. This allows evacuation of any evacuee left on the rescue floor concerned to the evacuation floor.

CITATION LIST

Patent Literature

[PTL 1] WO 2013/001643

SUMMARY

Technical Problem

However, in the disclosure of PTL 1, after the evacuation of the evacuee left on the rescue floor concerned, the evacuation guide evacuates through emergency stairs or the like without releasing an operation on the evacuation operation request device in some cases. In such a case, the car maintains traveling between the rescue floor concerned and the evacuation floor. This prevents any evacuee left on a rescue floor other than the rescue floor concerned from evacuating on the elevator.

The present invention is intended to solve the above-described problem. It is an object of the present invention to provide an elevator device that uses an elevator so as to be able to continuously evacuate evacuees left in a building.

Solution to Problem

An elevator device according to the present invention includes an evacuation operation mode requesting device provided at a hall of an elevator on a rescue floor and configured to be operated, a car operation instructing device provided at the hall of the elevator on the rescue floor and configured to be operated, and a control device configured to set an operation mode of the elevator to an evacuation operation mode in which a car of the elevator travels between a rescue floor concerned and an evacuation floor when the evacuation operation mode requesting device is maintained in an operated state, maintain an evacuation operation mode corresponding to the rescue floor concerned when the car operation instructing device is operated on the rescue floor concerned before a predetermined time passes from when the car stops at the rescue floor concerned during the evacuation operation mode corresponding to the rescue floor concerned, and release the evacuation operation mode corresponding to the rescue floor concerned when the car operation instructing device is not operated on the rescue floor concerned before the predetermined time passes from when the car stops at the rescue floor concerned during the evacuation operation mode corresponding to the rescue floor concerned.

Advantageous Effects of Invention

According to the present invention, the control device automatically releases the evacuation operation mode corresponding to the rescue floor concerned when the car operation instructing device is not operated before the predetermined time passes. This allows setting of an evacuation operation mode corresponding to another rescue floor. As a result, any evacuee left in a building can be continuously evacuated using the elevator.

BRIEF DESCRIPTION OF DRAWINGS

FIG. 7 is a flowchart for describing the operation of the elevator device according to Embodiment 1 of the present invention.

DESCRIPTION OF EMBODIMENTS

Embodiments of the present invention will be described with reference to the accompanying drawings. In each drawing, any identical or equivalent part is denoted by an identical reference sign. Any duplicate description of such a part will be simplified or omitted as appropriate.

Embodiment 1

Figure 1:
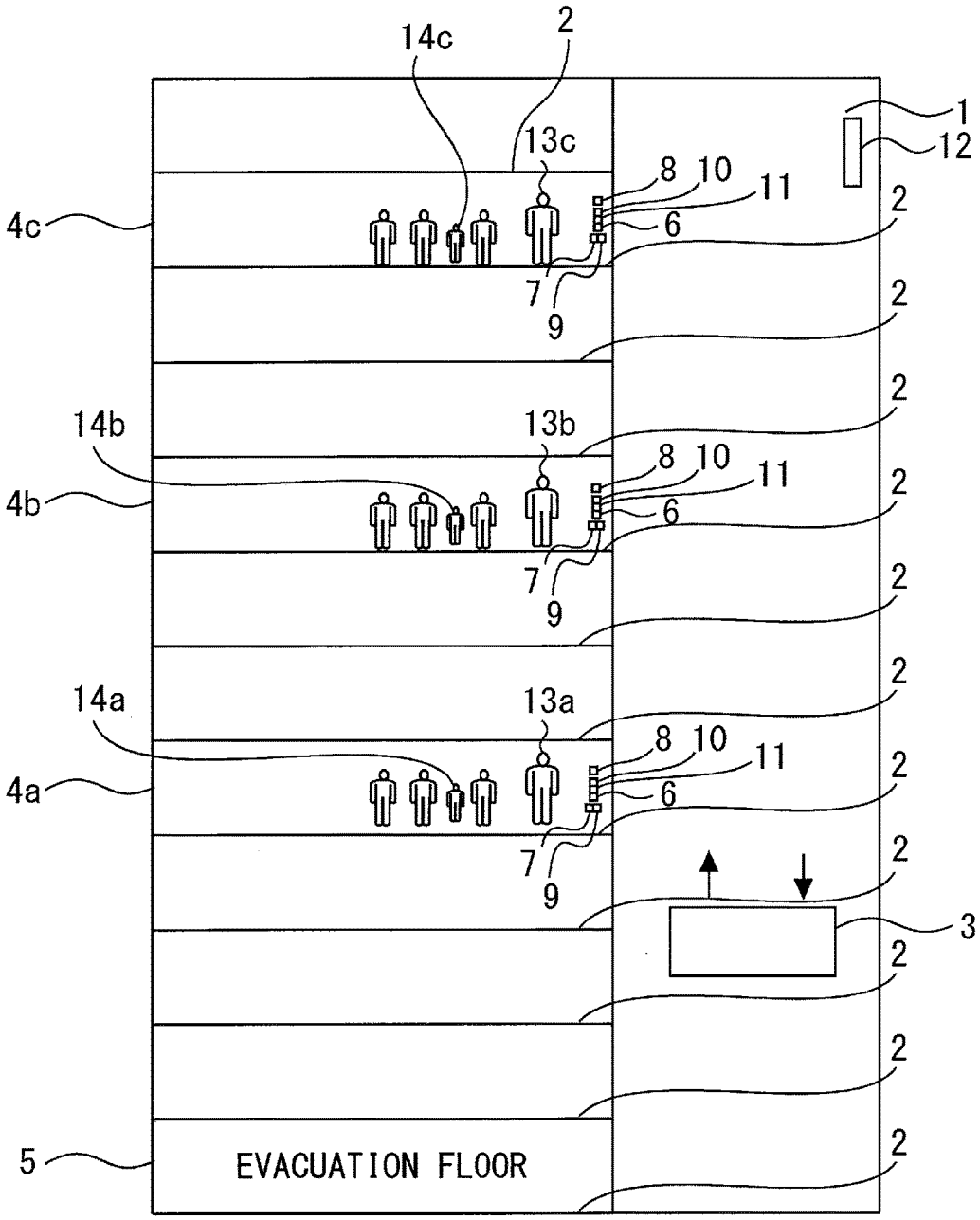
FIG. 1 is a configuration diagram of a building utilizing an elevator device according to Embodiment 1 of the present invention.

FIG. 1 is a configuration diagram of a building utilizing an elevator device according to Embodiment 1 of the present invention.

In FIG. 1, the building includes a plurality of floors. For example, the plurality of floors are the first to twelfth floors. A hoistway 1 for an elevator is provided on one side of the building. The hoistway 1 penetrates each floor of the building. A hall 2 of the elevator is provided on each floor of the building. Each hall 2 faces to the hoistway 1. A car 3 of the elevator is provided to be able to move up and down inside the hoistway 1.

At least one rescue floor is set for the building in advance. For example, three rescue floors are set in advance. For example, a rescue floor 4*a* is set to the fifth floor. For example, a rescue floor 4*b* is set to the eighth floor. For example, a rescue floor 4*c* is set to the eleventh floor. At least one evacuation floor is set for the building in advance. For example, an evacuation floor 5 is set to the first floor as the bottom floor.

An evacuation operation mode requesting device 6 is provided at the hall 2 of the elevator on each of the rescue floors 4*a*, 4*b*, and 4*c*. The evacuation operation mode requesting device 6 includes, for example, a switch. The evacuation operation mode requesting device 6 is configured to be operated. A car operation instructing device 7 is provided at the hall 2 of the elevator on each of the rescue floors 4*a*, 4*b*, and 4*c*. The car operation instructing device 7 is configured to be operated.

A notification device 8 is provided at the hall 2 of the elevator on each of the rescue floors 4*a*, 4*b*, and 4*c*. For example, the notification device 8 is configured to notify information based on a received signal by sound. An illumination device 9 is provided at the hall 2 of the elevator on each of the rescue floors 4*a*, 4*b*, and 4*c*. The illumination device 9 is configured to be turned on based on the received signal.

An appointment status indicating device 10 is provided at the hall 2 of the elevator on each of the rescue floors 4*a*, 4*b*, and 4*c*. The appointment status indicating device 10 is configured to indicate information based on the received signal. An entry prohibition indicating device 11 is provided at the hall 2 of the elevator on each of the rescue floors 4*a*, 4*b*, and 4*c*. The entry prohibition indicating device 11 is configured to indicate information based on the received signal.

For example, a control device 12 of the elevator is provided at an upper part of the hoistway 1. The control device 12 is electrically connected with the evacuation operation mode requesting device 6, the car operation instructing device 7, the notification device 8, the illumination device 9, the appointment status indicating device 10, and the entry prohibition indicating device 11.

When a disaster such as fire has occurred in the building, any evacuee left in the building needs to be evacuated. In such a case, an evacuation guide 13*a* promptly rushes to the hall 2 of the rescue floor 4*a* for which the evacuation guide 13*a* is responsible. An evacuation guide 13*b* promptly rushes to the hall 2 of the rescue floor 4*b* for which the evacuation guide 13*b* is responsible. An evacuation guide 13*c* promptly rushes to the hall 2 of the rescue floor 4*c* for which the evacuation guide 13*c* is responsible.

The evacuation guide 13*a* uses the car 3 to perform evacuation guidance of an evacuee 14*a* to the evacuation floor 5. The evacuation guide 13*b* uses the car 3 to perform evacuation guidance of an evacuee 14*b* to the evacuation floor 5. The evacuation guide 13*c* uses the car 3 to perform evacuation guidance of an evacuee 14*c* to the evacuation floor 5.

For example, the evacuation guide 13*a* operates the evacuation operation mode requesting device 6 on the rescue floor 4*a*. When the evacuation operation mode requesting device 6 is maintained in an operated state, the control device 12 sets an operation mode of the elevator to an evacuation operation mode in which the car 3 travels between the rescue floor 4*a* and the evacuation floor 5.

The control device 12 maintains the evacuation operation mode corresponding to the rescue floor 4*a* when the evacuation guide 13*a* operates the car operation instructing device 7 before a predetermined time passes from when the car 3 stops at the rescue floor 4*a* during the evacuation operation mode corresponding to the rescue floor 4*a*. In this case, the control device 12 closes the doors of the elevator and moves the car 3 to the evacuation floor 5.

The control device 12 releases the evacuation operation mode corresponding to the rescue floor 4*a* when the evacuation guide 13*a* does not operate the car operation instructing device 7 before the predetermined time passes from when the car 3 stops at the rescue floor 4*a* during the evacuation operation mode corresponding to the rescue floor 4*a*. In this case, the control device 12 closes the doors of the elevator and moves the car 3 to the evacuation floor 5.

Before closing the doors of the elevator after releasing the evacuation operation mode corresponding to the rescue floor 4*a*, the control device 12 causes the notification device 8 to notify that the evacuation operation mode corresponding to the rescue floor 4*a* is scheduled to be released. When the evacuation guide 13*a* wants to maintain the evacuation operation mode, the evacuation guide 13*a* operates the car operation instructing device 7 before the doors of the elevator are fully closed. The control device 12 cancels the releasing schedule of the evacuation operation mode when the car operation instructing device 7 is operated.

For example, when the operation mode of the elevator is set to the evacuation operation mode in which the car 3 travels between the rescue floor 4*a* and the evacuation floor 5, the evacuation guide 13*b* operates the evacuation operation mode requesting device 6 on the rescue floor 4*b*. In this case, the control device 12 appoints the evacuation operation mode corresponding to the rescue floor 4*b*. Then, the illumination device 9 on the rescue floor 4*b* is turned on. The appointment status indicating device 10 of the rescue floor 4*b* indicates different information depending on an order at which the operation mode of the elevator is set to the evacuation operation mode corresponding to the rescue floor 4*b*.

For example, when the hoistway 1 or the car 3 becomes flooded, the control device 12 sets the operation mode of the elevator to a pause mode. For example, when the temperature of the hoistway 1 or the car 3 becomes high, the control device 12 sets the operation mode of the elevator to the pause mode. In these cases, the entry prohibition indicating devices 11 on the rescue floors 4*a*, 4*b*, and 4*c* indicate information that entry to the car 3 is prohibited, which is content different from normal content. For example, the entry prohibition indicating device 11 indicates the information that entry to the car 3 is prohibited in a flashing manner.

Next, the control device 12 will be described with reference to FIG. 2.

Figure 2:
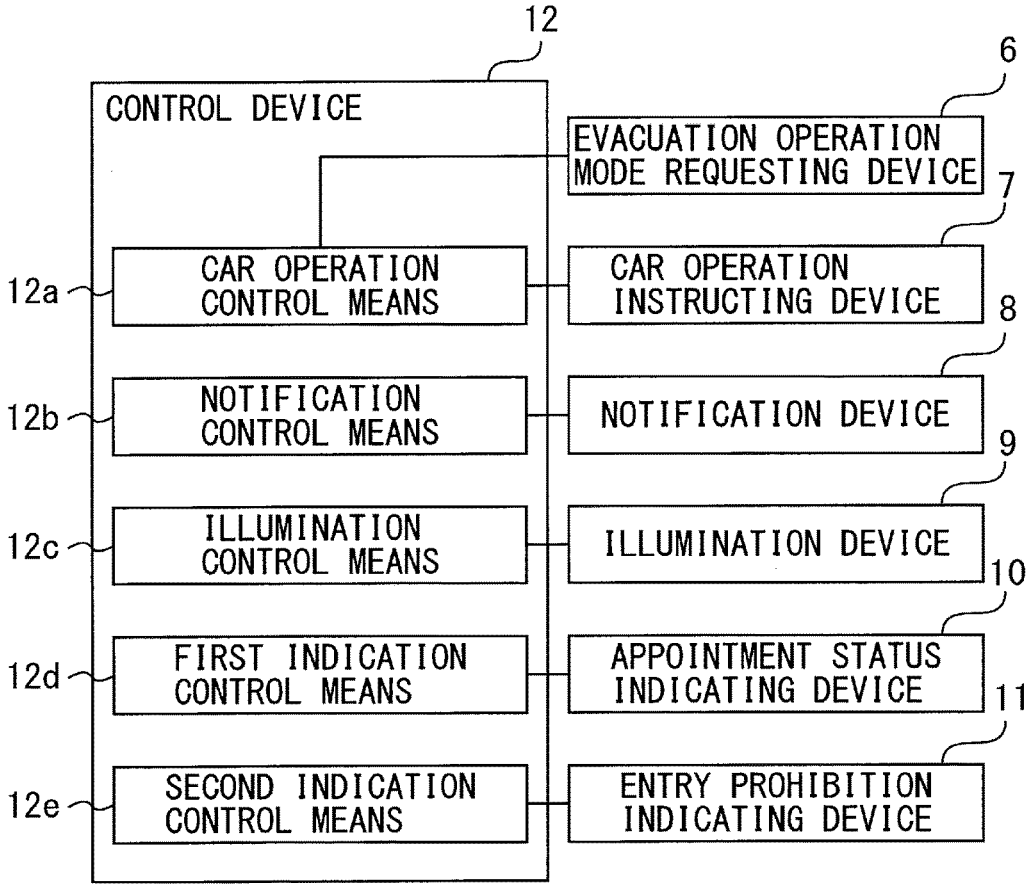
FIG. 2 is a block diagram of a control device of the elevator device according to Embodiment 1 of the present invention.

FIG. 2 is a block diagram of the control device of the elevator device according to Embodiment 1 of the present invention.

For example, the control device 12 is a microcomputer including a CPU and a memory. For example, the control device 12 includes a car operation control means 12*a*, a notification control means 12*b*, an illumination control means 12*c*, a first indication control means 12*d*, and a second indication control means 12*e*.

The car operation control means 12*a* controls the operation of the car 3. For example, the car operation control means 12*a* receives an evacuation operation mode request signal transmitted when the evacuation operation mode requesting device 6 is operated. The car operation control means 12*a* sets the operation mode of the elevator to an evacuation operation mode based on this evacuation operation mode request signal. For example, the car operation control means 12*a* receives a move request signal transmitted when the car operation instructing device 7 is operated before a predetermined time passes from when the car 3 stops at, for example, the rescue floor 4*a*. The car operation control means 12*a* maintains the evacuation operation mode corresponding to the rescue floor 4*a* based on this move request signal. In this case, the car operation control means 12*a* moves the car 3 to the evacuation floor 5. For example, when the car operation control means 12*a* does not receive the move request signal transmitted when the car operation instructing device 7 is operated before the predetermined time passes from when the car 3 stops at the rescue floor 4*a*, the car operation control means 12*a* releases the evacuation operation mode corresponding to the rescue floor 4*a*. In this case, the car operation control means 12*a* moves the car 3 to the evacuation floor 5. For example, having received a cancellation signal transmitted when the car operation instructing device 7 is operated before the doors of the elevator are fully closed on the rescue floor 4*a*, the car operation control means 12*a* cancels the releasing schedule of the evacuation operation mode based on this cancellation signal.

The notification control means 12*b* controls notification by the notification device 8. For example, the notification control means 12*b* transmits a notification signal to the notification device 8 on, for example, the rescue floor 4*a* before the doors of the elevator are closed because the car operation instructing device 7 is not operated before a predetermined time passes from when the car 3 stops at the rescue floor 4*a*. Accordingly, the notification device 8 on the rescue floor 4*a* notifies, based on this notification signal, that the evacuation operation mode is scheduled to be released.

The illumination control means 12*c* controls illumination by the illumination device 9. For example, when the car operation control means 12*a* appoints an evacuation operation mode in which the car 3 travels between, for example, the rescue floor 4*b* and the evacuation floor 5, the illumination control means 12*c* transmits an illumination signal to the illumination device 9 on the rescue floor 4*b*. Accordingly, the illumination device 9 on the rescue floor 4*b* is turned on based on this illumination signal.

The first indication control means 12*d* controls indication by the appointment status indicating device 10. For example, the first indication control means 12*d* transmits different appointment state signals to the appointment status indicating device 10 on, for example, the rescue floor 4*a* depending on an order at which the operation mode of the elevator is set to the evacuation operation mode corresponding to the rescue floor 4*a*. Accordingly, based on this appointment state signal, the appointment status indicating device 10 on the rescue floor 4*a* indicates different information depending on the order at which the operation mode of the elevator is set to the evacuation operation mode corresponding to the rescue floor 4*a*.

The second indication control means 12*e* controls indication by the entry prohibition indicating device 11. For example, when the operation mode of the elevator becomes the pause mode, the second indication control means 12*e* transmits an entry prohibition signal to the entry prohibition indicating device 11 on, for example, the rescue floor 4*a*. Accordingly, the entry prohibition indicating device 11 on the rescue floor 4*a* indicates information that entry to the car 3 is prohibited, which is content different from normal content.

Next, the hall 2 on each of the rescue floors 4*a* to 4*c* will be described with reference to FIG. 3.

Figure 3:
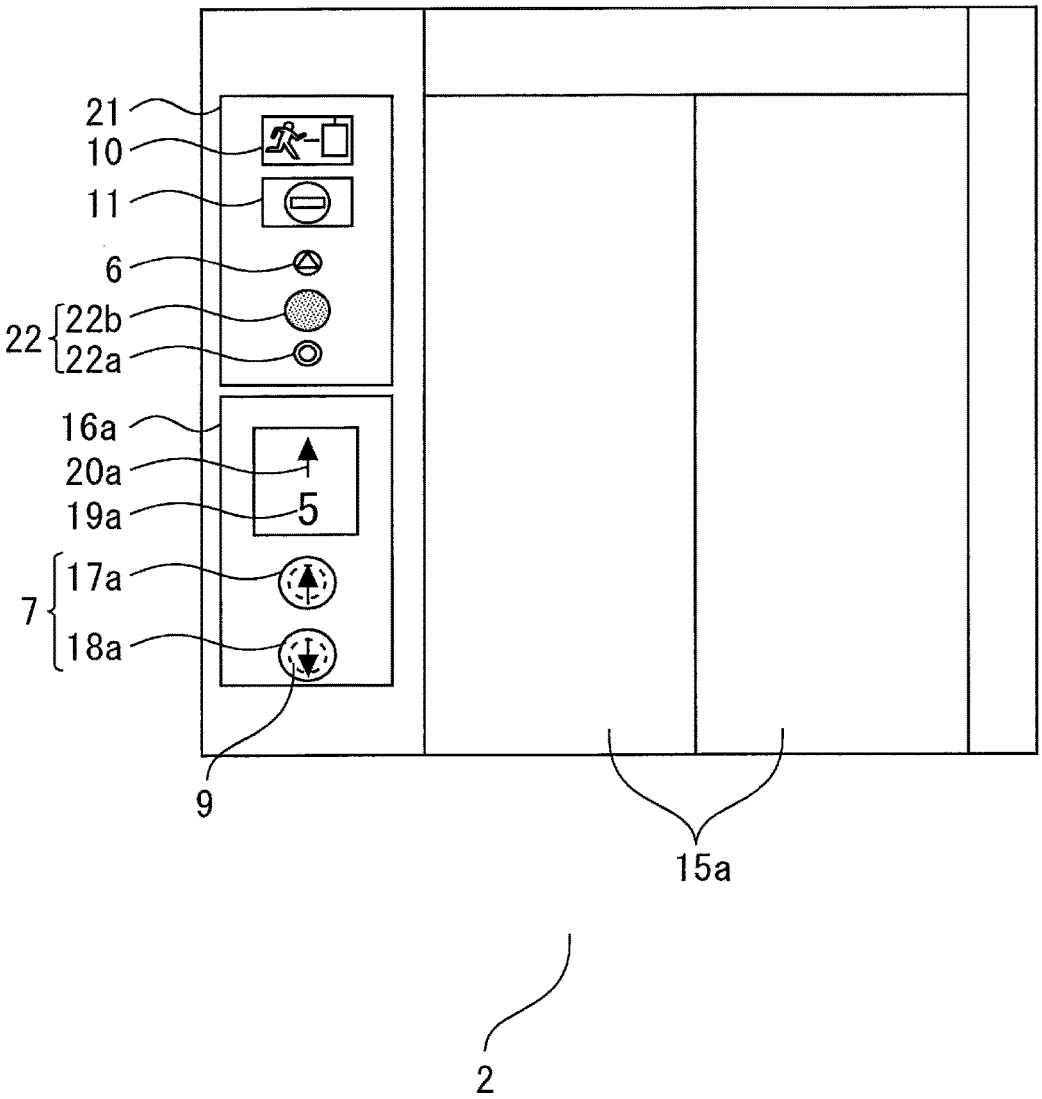
FIG. 3 is a front view of a hall on a rescue floor, utilizing the elevator device according to Embodiment 1 of the present invention.

FIG. 3 is a front view of a hall on a rescue floor, utilizing the elevator device according to Embodiment 1 of the present invention.

As illustrated in FIG. 3, doors 15*a* are provided at the entrance of the hall 2. A hall operating panel 16*a* is provided at a bottom part on one side of the entrance of the hall 2. The hall operating panel 16*a* is connected with the control device 12 (not illustrated in FIG. 3). The hall operating panel 16*a* includes the car operation instructing device 7 and an indication device.

The car operation instructing device 7 is provided at a bottom part of the hall operating panel 16*a*. The car operation instructing device 7 serves as operation buttons. The operation buttons include an up button 17*a* and a down button 18*a*. Each operation button includes a button lamp. The button lamp serves as the illumination device 9. The indication device is provided at an upper part of the hall operating panel 16*a*. The indication device includes a position indicating device 19*a* and a moving direction indicating device 20*a*. The position indicating device 19*a* is provided at a bottom part of the indication device. The position indicating device 19*a* indicates information on the position of the car 3. For example, the position indicating device 19*a* indicates a number specifying a floor nearest to the position of the car 3. The moving direction indicating device 20*a* is provided at an upper part of the indication device. The moving direction indicating device 20*a* indicates information on the moving direction of the car 3. For example, the moving direction indicating device 20*a* indicates the moving direction of the car 3 by an arrow.

An evacuation guidance operating panel 21 is provided at an upper part on the one side of the entrance of the hall 2. The evacuation guidance operating panel 21 is connected with the control device 12 (not illustrated in FIG. 3). The evacuation guidance operating panel 21 includes the evacuation operation mode requesting device 6, the appointment status indicating device 10, the entry prohibition indicating device 11, and a report device 22.

The evacuation operation mode requesting device 6 is provided at a central part of the evacuation guidance operating panel 21. The appointment status indicating device 10 serves as an evacuation guidance indicating device. The appointment status indicating device 10 is provided above the evacuation operation mode requesting device 6. The entry prohibition indicating device 11 is provided between the evacuation operation mode requesting device 6 and the appointment status indicating device 10. The report device 22 is provided below the evacuation operation mode requesting device 6. The report device 22 includes a call button 22*a* and a speaker microphone 22*b*.

Figure 4:
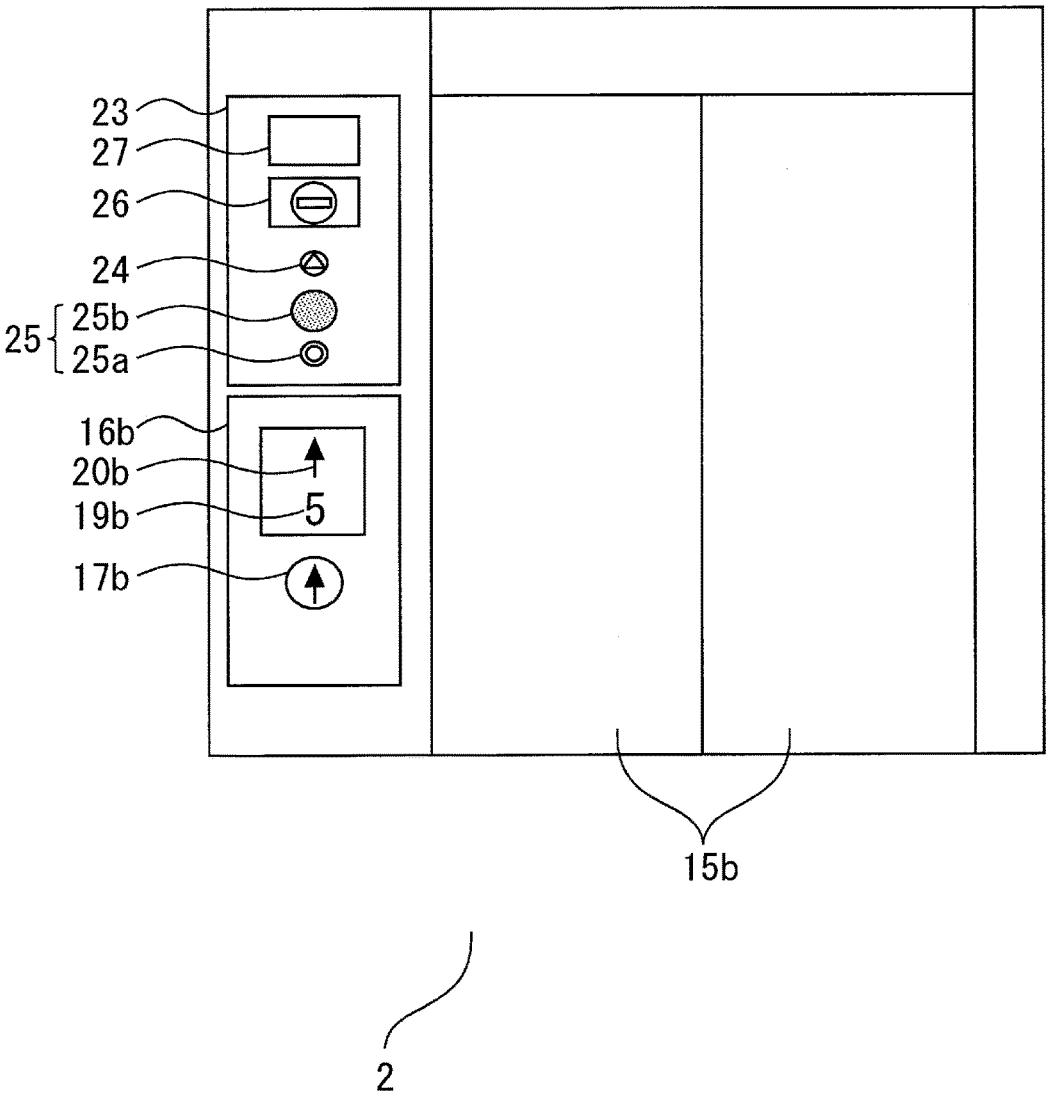
FIG. 4 is a front view of a hall on an evacuation floor, utilizing the elevator device according to Embodiment 1 of the present invention.

Next, the hall 2 on the evacuation floor 5 will be described with reference to FIG. 4. FIG. 4 is a front view of the hall on the evacuation floor, utilizing the elevator device according to Embodiment 1 of the present invention.

As illustrated in FIG. 4, doors 15*b* are provided at the entrance of the hall 2. A hall operating panel 16*b* is provided at a bottom part on the one side of the entrance of the hall 2. The hall operating panel 16*b* is connected with the control device 12 (not illustrated in FIG. 4). The hall operating panel 16*b* includes an operation button and an indication device.

The operation button is provided at a bottom part of the hall operating panel 16*b*. The operation button includes an up button 17*b*. The indication device is provided at an upper part of the hall operating panel 16*b*. The indication device includes a position indicating device 19*b* and a moving direction indicating device 20*b*. The position indicating device 19*b* is provided at a bottom part of the indication device. The position indicating device 19*b* indicates information on the position of the car 3. For example, the position indicating device 19*b* indicates a number specifying a floor nearest to the position of the car 3. The moving direction indicating device 20*b* is provided at an upper part of the hall operating panel 16*b*. The moving direction indicating device 20*b* indicates the moving direction of the car 3. For example, the moving direction indicating device 20*b* indicates the moving direction of the car 3 by an arrow.

A firefighter operating panel 23 is provided at an upper part on the one side of the entrance of the hall 2. The firefighter operating panel 23 is connected with the control device 12 (not illustrated in FIG. 4). The firefighter operating panel 23 includes a forced return operation mode requesting device 24, a report device 25, a entry prohibition indicating device 26, and a use condition indicating device 27.

The forced return operation mode requesting device 24 is provided at a central part of the firefighter operating panel 23. For example, the forced return operation mode requesting device 24 includes a switch. The report device 25 is provided below the forced return operation mode requesting device 24. The report device 25 includes a call button 25*a* and a speaker microphone 25*b*. The entry prohibition indicating device 26 is provided above the forced return operation mode requesting device 24. The use condition indicating device 27 is provided above the entry prohibition indicating device 26.

A prohibition indicating device substantially equivalent to the entry prohibition indicating devices 11 and 26 is provided at the hall 2 on any floor other than the rescue floors 4*a* to 4*c* and the evacuation floor 5. A hall operating panel substantially equivalent to the hall operating panels 16*a* and 16*b* is provided at the hall 2 on any floor other than the rescue floors 4*a* to 4*c* and the evacuation floor 5.

Next, the inside of the car 3 will be described with reference to FIG. 5.

Figure 5:
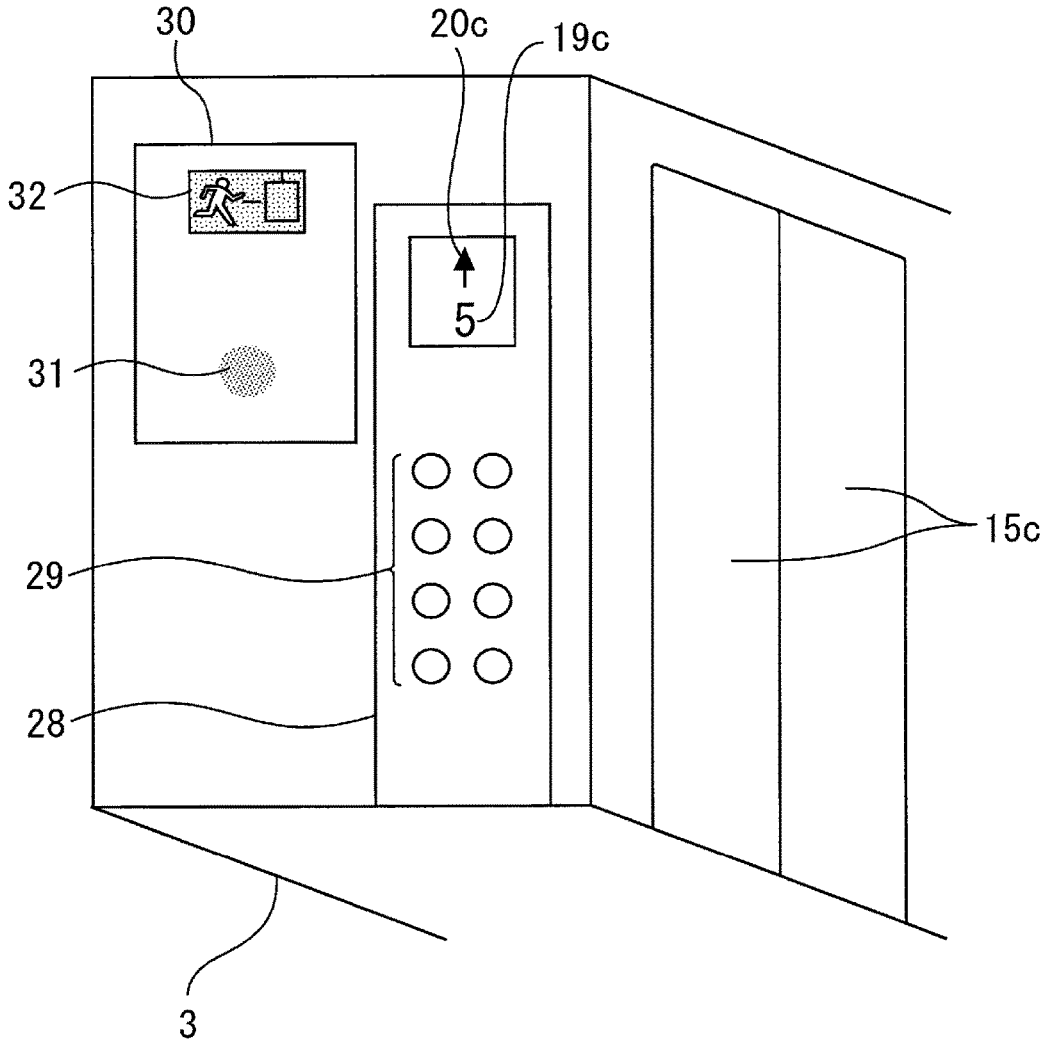
FIG. 5 is a perspective view of the inside of a car of the elevator device according to Embodiment 1 of the present invention.

FIG. 5 is a perspective view of the inside of the car of the elevator device according to Embodiment 1 of the present invention.

As illustrated in FIG. 5, doors 15*c* are provided at the entrance of the car 3. A car operating panel 28 is provided on a sidewall on one side of the car 3. The car operating panel 28 is connected with the control device 12 (not illustrated in FIG. 5). The car operating panel 28 includes an operation button 29 and an indication device.

The operation button 29 is provided at a bottom part of the car operating panel 28. The indication device is provided at an upper part of the car operating panel 28. The indication device includes a position indicating device 19*c* and a moving direction indicating device 20*c*. The position indicating device 19*c* is provided at a bottom part of the indication device. The position indicating device 19*c* indicates information on the position of the car 3. For example, the position indicating device 19*c* indicates a number specifying a floor nearest to the position of the car 3. The moving direction indicating device 20*c* is provided at an upper part of the indication device. The moving direction indicating device 20*c* indicates information on the moving direction of the car 3. For example, the moving direction indicating device 20*c* indicates the moving direction of the car 3 by an arrow.

A communication device 30 is provided at an upper part of the sidewall on the one side of the car 3. The communication device 30 is provided closer to the back of the car 3 than the car operating panel 28. The communication device 30 is connected with the control device 12 (not illustrated in FIG. 5). The communication device 30 includes a speaker microphone 31 and an evacuation guidance indicating device 32.

The speaker microphone 31 is provided at a bottom part of the communication device 30. The evacuation guidance indicating device 32 is provided at an upper part of the communication device 30.

Next, exemplary indication by the appointment status indicating device 10 with reference to FIG. 6 will be described.

Figure 6:
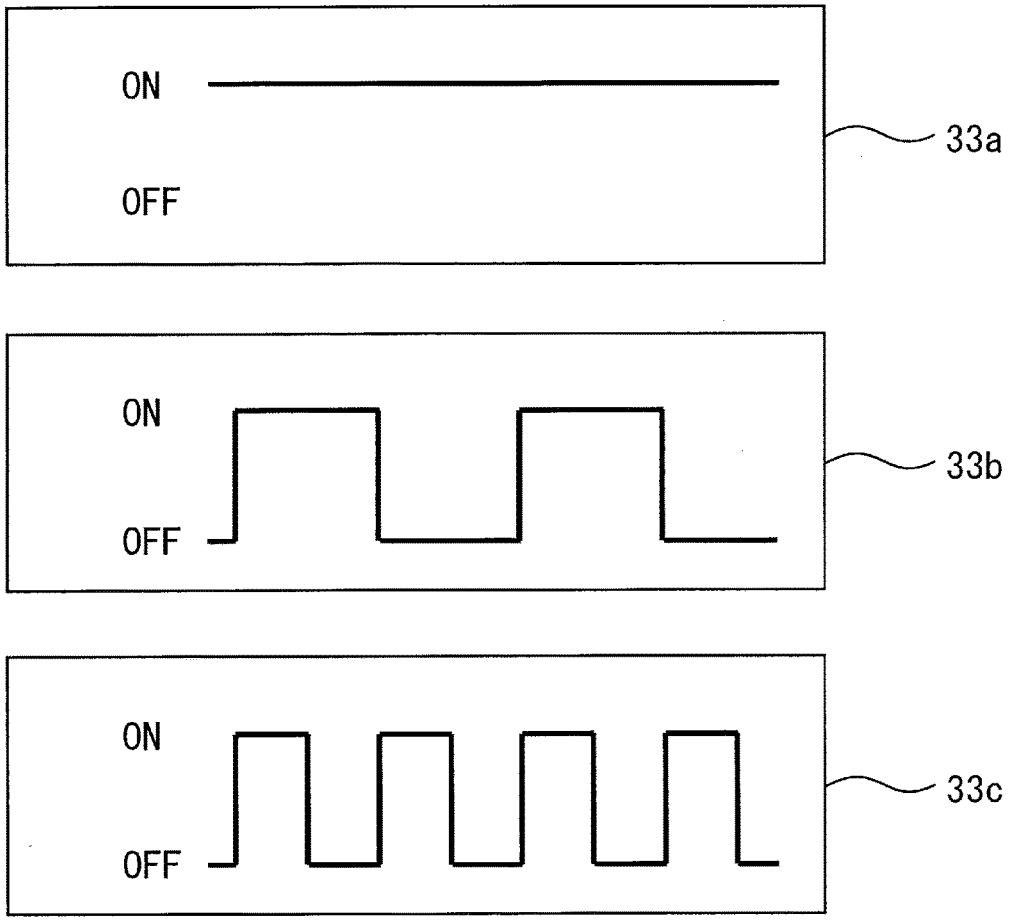
FIG. 6 is a diagram for describing exemplary indication by an appointment status indicating device of the elevator device according to Embodiment 1 of the present invention.

FIG. 6 is a diagram for describing exemplary indication by the appointment status indicating device 10 of the elevator device according to Embodiment 1 of the present invention.

In FIG. 6, block 33*a* illustrates indication by the appointment status indicating device 10 on, for example, the rescue floor concerned 4*a* when the operation mode of the elevator is the evacuation operation mode corresponding to the rescue floor concerned 4*a*. Block 33*b* illustrates indication by the appointment status indicating device 10 on, for example, the rescue floor concerned 4*a* when the operation mode of the elevator is set to the evacuation operation mode corresponding to the rescue floor 4*a* at the first order. Block 33*c* illustrates indication by the appointment status indicating device 10 on, for example, the rescue floor concerned 4*a* when the operation mode of the elevator is set to the evacuation operation mode corresponding to the rescue floor 4*a* at the second order or later.

In block 33*a*, the appointment status indicating device 10 on, for example, the rescue floor concerned 4*a* is constantly turned on. In block 33*b*, the appointment status indicating device 10 on, for example, the rescue floor concerned 4*a* is repeatedly turned on and off at an interval of one second. In block 33*c*, the appointment status indicating device 10 on, for example, the rescue floor concerned 4*a* is repeatedly turned on and off at an interval of 0.5 second.

Next, the operation of the elevator device will be described with reference to FIG. 7. FIG. 7 is a flowchart for describing the operation of the elevator device according to Embodiment 1 of the present invention.

At step S1, the control device 12 detects that the evacuation operation mode requesting device 6 is operated. Thereafter, the process proceeds to step S2. At step S2, the control device 12 judges whether the evacuation operation mode requesting device 6 on another rescue floor different from a rescue floor on which the evacuation operation mode requesting device 6 determined to be operated at step S1 is located is already in the operated state.

If the evacuation operation mode requesting device 6 on another rescue floor different from the rescue floor concerned is already in the operated state at step S2, the process proceeds to step S3. At step S3, the control device 12 appoints an evacuation operation mode corresponding to the rescue floor concerned. Then, the control device 12 turns on the illumination device 9 on the rescue floor concerned.

If the evacuation operation mode requesting device 6 on another rescue floor different from the rescue floor concerned is not in the operated state at step S2, the process proceeds to step S4. When operations on the evacuation operation mode requesting devices 6 on all other rescue floors different from the rescue floor concerned are released at step S3, the process proceeds to step S4.

At step S4, the control device 12 sets the rescue floor concerned as a selected rescue floor. Thereafter, the process proceeds to step S5. At step S5, the control device 12 moves the car 3 to the selected rescue floor. When the car 3 arrives at the selected rescue floor, the control device 12 opens the doors 15*a* and 15*c* on the selected rescue floor. Then, an evacuation guide on the selected rescue floor guides any evacuee left on the selected rescue floor into the car 3.

After step S5, the process proceeds to step S6. At step S6, the control device 12 judges whether a predetermined judgment time has passed from when the car 3 stops at the selected rescue floor. For example, the judgment time is determined in advance so that evacuation activity of the evacuation guide on the selected rescue floor can be carried out without trouble, and evacuation activity in the entire building can be efficiently carried out. For example, the judgment time is determined to be five minutes in advance.

If the judgment time has not passed from when the car 3 stops at the selected rescue floor at step S6, the process proceeds to step S7. At step S7, the control device 12 judges whether the car operation instructing device 7 on the selected rescue floor is operated.

If the car operation instructing device 7 on the selected rescue floor is not operated at step S7, the process returns to step S6. If the car operation instructing device 7 on the selected rescue floor is operated at step S7, the process proceeds to step S8.

At step S8, the control device 12 starts closing the doors 15*a* and 15*c* on the selected rescue floor. Thereafter, the process proceeds to step S9, and the control device 12 judges whether the car operation instructing device 7 on the selected rescue floor is operated again before the doors 15*a* and 15*c* on the selected rescue floor are fully closed.

If the car operation instructing device 7 on the selected rescue floor is operated again before the doors 15*a* and 15*c* on the selected rescue floor are fully closed at step S9, the process proceeds to step S10. At step S10, the control device 12 performs door reversal to open the doors 15*a* and 15*c* on the selected rescue floor. Thereafter, the processing starting at step S6 is repeated.

If the car operation instructing device 7 on the selected rescue floor is not operated again before the doors 15*a* and 15*c* on the selected rescue floor are fully closed at step S9, the process proceeds to step S11. At step S11, the control device 12 moves the car 3 to the evacuation floor 5 by force. When the car 3 arrives at the evacuation floor 5, the control device 12 opens the doors 15*b* and 15*c* only for a predetermined time.

Then, the control device 12 guides the evacuee in the car 3 to the outside of the car 3. For example, the control device 12 guides the evacuee in the car 3 to the outside of the car 3 by voice. For example, the control device 12 guides the evacuee in the car 3 to the outside of the car 3 by chime. For example, the control device 12 guides any evacuee in the car 3 to the outside of the car 3 by temporarily turning off lighting inside the car 3. Thereafter, when the predetermined time has passed, the control device 12 closes the doors 15*b* and 15*c*. Then, the process proceeds to step S12.

At step S12, the control device 12 judges whether the evacuation operation mode requesting device 6 on the selected rescue floor is maintained in the operated state. If the evacuation operation mode requesting device 6 on the selected rescue floor is maintained in the operated state at step S12, the processing starting at step S5 is repeated. If the evacuation operation mode requesting device 6 on the selected rescue floor is not maintained in the operated state at step S12, the process proceeds to step S13. At step S13, the control device 12 judges whether an evacuation operation mode is appointed.

If an evacuation operation mode is appointed at step S13, the process proceeds to step S14. At step S14, the control device 12 sets another rescue floor as the selected rescue floor in accordance with the content of the appointment of an evacuation operation mode. Thereafter, the processing starting at step S5 is repeated. If no evacuation operation mode is appointed at step S13, the process proceeds to step S15. At step S15, the control device 12 ends the evacuation operation mode.

If the judgment time has passed from when the car 3 stops at the selected rescue floor at step S6, the process proceeds to step S16. At step S16, the control device 12 activates the notification device 8 on this selected evacuation floor. Specifically, the notification device 8 notifies, by sound, that the evacuation operation mode corresponding to the selected rescue floor is scheduled to be released. For example, the notification device 8 notifies, by chime, that the evacuation operation mode corresponding to the selected rescue floor is scheduled to be released.

After step S16, the process proceeds to step S17. At step S17, the control device 12 judges whether the car operation instructing device 7 on the selected rescue floor is operated. If the car operation instructing device 7 on the selected rescue floor is operated at step S17, the processing starting at step S6 is repeated. If the car operation instructing device 7 on the selected rescue floor is not operated at step S17, the process proceeds to step S18.

At step S18, the control device 12 closes the doors 15*b* and 15*c* on the selected rescue floor. Thereafter, the control device 12 moves the car 3 to the evacuation floor 5 by force. When the car 3 arrives at the evacuation floor 5, the control device 12 opens the doors 15*b* and 15*c* for a predetermined time.

Then, the control device 12 guides any evacuee in the car 3 to the outside of the car 3. For example, the control device 12 guides the evacuee in the car 3 to the outside of the car 3 by voice. For example, the control device 12 guides the evacuee in the car 3 to the outside of the car 3 by chime. For example, the control device 12 guides the evacuee in the car 3 to the outside of the car 3 by temporarily turning off lighting inside the car 3. Thereafter, when the predetermined time has passed, the control device 12 closes the doors 15*b* and 15*c*. Then, the processing starting at step S13 is repeated.

According to Embodiment 1 described above, the evacuation operation mode corresponding to, for example, the rescue floor concerned 4*a* is maintained when the evacuation operation mode requesting device 6 is maintained in the operated state. In this case, the car 3 continues stopping at the rescue floor concerned 4*a* until, for example, the evacuation guide 13*a* operates the car operation instructing device 7. If the car operation instructing device 7 is not operated before a predetermined time passes, the control device 12 automatically releases the evacuation operation mode corresponding to the rescue floor concerned 4*a*. This allows setting of the evacuation operation mode corresponding to another rescue floor. As a result, for example, the evacuee 14*a* left in the building can be continuously evacuated using the elevator.

Subsequently, the control device 12 releases stopping of the car 3 at the rescue floor concerned 4*a*. Thereafter, the control device 12 closes the doors 15*b* and 15*c*. Then, the control device 12 moves the car 3 to the evacuation floor 5. This allows evacuation of, for example, the evacuee 14*a* left in the car 3 on the rescue floor concerned 4*a* to the evacuation floor 5 when the evacuation guide 13*a* on the rescue floor concerned 4*a* has evacuated through emergency stairs or the like without releasing an operation on the evacuation operation mode requesting device 6.

The notification device 8 notifies that the evacuation operation mode is scheduled to be released. This allows, for example, the evacuation guide 13*a* on the rescue floor concerned 4*a* to determine an appropriate way to handle the situation with taken into account the number of, for example, the evacuees 14*a* left on the rescue floor concerned 4*a*, and the like.

In this case, if the car operation instructing device 7 is operated, the releasing schedule of the evacuation operation mode is canceled. Accordingly, the evacuation guide 13*a* on the rescue floor concerned 4*a* can maintain the evacuation operation mode corresponding to the rescue floor concerned 4*a* when a large number of, for example, the evacuees 14*a* are left on the rescue floor concerned 4*a*.

The illumination device 9 is turned on when an evacuation operation mode is appointed. This allows, for example, the evacuation guide 13*a* on the rescue floor concerned 4*a* and the evacuee 14*a* left on the rescue floor concerned 4*a* to recognize that the evacuation operation mode corresponding to the rescue floor concerned 4*a* is set in a short time.

The appointment status indicating device 10 indicates different information depending on an order at which the evacuation operation mode corresponding to, for example, the rescue floor concerned 4*a* is set. This allows, for example, the evacuation guide 13*a* on the rescue floor concerned 4*a* and the evacuee 14*a* left on the rescue floor concerned 4*a* to know the order at which the evacuation operation mode corresponding to the rescue floor concerned 4*a* is set. As a result, the evacuation guide 13*a* on the rescue floor concerned 4*a* and the evacuee 14*a* left on the rescue floor concerned 4*a* can recognize an approximate time until the evacuation operation mode corresponding to the rescue floor concerned 4*a* is set.

The entry prohibition indicating device 11 indicates information that entry to the car 3 is prohibited when the elevator becomes the pause mode. This allows, for example, the evacuation guide 13*a* on the rescue floor concerned 4*a* and the evacuee 14*a* left on the rescue floor concerned 4*a* to recognize that it is unable to evacuate using the car 3.

INDUSTRIAL APPLICABILITY

As described above, the elevator device according to the present invention can be used in a system for continuously evacuating any evacuee left in the building.

REFERENCE SIGNS LIST

1 hoistway, 2 hall, 3 car, 4*a* to 4*c* rescue floor, 5 evacuation floor, 6 evacuation operation mode requesting device, 7 car operation instructing device notification device, 9 illumination device, 10 appointment status indicating device, 11 entry prohibition indicating device, 12 control device, 12*a* car operation control means, 12*b* notification control means, 12*c* illumination control means, 12*d* first indication control means, 12*e* second indication control means, 13*a*, 13*b*, 13*c* evacuation guide, 14*a*, 14*b*, 14*c* evacuee, 15*a*, 15*b*, 15*c* doors, 16*a*, 16*b* hall operating panel, 17*a*, 17*b* up button, 18*a* down button, 19*a* to 19*c* position indicating device, 20*a*, 20*b*, 20*c* moving direction indicating device, 21 evacuation guidance operating panel, 22 report device, 22*a* call button, 22*b* speaker microphone, 23 firefighter operating panel, 24 forced return operation mode requesting device, 25 report device, 25*a* call button, 25*b* speaker microphone, 26 entry prohibition indicating device, 27 use condition indicating device, 28 car operating panel, 29 operation button, 30 communication device, 31 speaker microphone, 32 evacuation guidance indicating device, 33*a*, 33*b*, 33*c* block

The invention claimed is:

1. An elevator device comprising:

an evacuation operation mode requesting device provided at a hall of an elevator on a rescue floor and configured to be operated;

a car operation instructing device provided at the hall of the elevator on the rescue floor and configured to be operated; and a control device configured to:

set an operation mode of the elevator to an evacuation operation mode in which a car of the elevator travels between a rescue floor concerned and an evacuation floor wherein the car moves from the rescue floor concerned to the evacuation floor when the car carries an evacuee when the evacuation operation mode requesting device is maintained in an operated state;

maintain the evacuation operation mode corresponding to the rescue floor concerned based on the car operation instructing device being operated on the rescue floor concerned before a predetermined time passes from when the car stops at the rescue floor concerned during an evacuation operation mode corresponding to the rescue floor concerned; and release the evacuation operation mode corresponding to the rescue floor concerned when the car operation instructing device is not operated on the rescue floor concerned before the predetermined time passes from when the car stops at the rescue floor concerned during the evacuation operation mode corresponding to the rescue floor concerned.

2. The elevator device according to claim 1, wherein, when the car operation instructing device is not operated on the rescue floor concerned before the predetermined time passes from when the car stops at the rescue floor concerned during the evacuation operation mode corresponding to the rescue floor concerned, the control device closes doors of the elevator after releasing the evacuation operation mode corresponding to the rescue floor concerned and moves the car to the evacuation floor.

3. The elevator device according to claim 1, further comprising a notification device provided at the hall of the elevator on the rescue floor and configured to notify that the evacuation operation mode corresponding to the rescue floor concerned is scheduled to be released before the doors of the elevator are closed after the evacuation operation mode corresponding to the rescue floor concerned is released because the car operation instructing device is not operated on the rescue floor concerned before the predetermined time passes from when the car stops at the rescue floor concerned during the evacuation operation mode corresponding to the rescue floor concerned.

4. The elevator device according to claim 3, wherein, when the car operation instructing device is operated on the rescue floor concerned before the doors of the elevator are fully closed after it is notified by the notification device that the evacuation operation mode corresponding to the rescue floor concerned is scheduled to be released, the control device cancels the schedule of release of the evacuation operation mode corresponding to the rescue floor concerned.

5. The elevator device according to claim 1, further comprising an illumination device provided at the hall of the elevator on the rescue floor concerned and configured to be turned on when the evacuation operation mode requesting device is operated on the rescue floor concerned while the operation mode of the elevator is set to an evacuation operation mode corresponding to another rescue floor, and the control device appoints the evacuation operation mode corresponding to the rescue floor.

6. The elevator device according to claim 5, further comprising an appointment status indicating device provided at the hall of the elevator on the rescue floor and configured to indicate different information depending on an order at which the operation mode of the elevator is set to the evacuation operation mode corresponding to the rescue floor concerned.

7. The elevator device according to claim 1, further comprising an entry prohibition indicating device provided at the hall of the elevator on the rescue floor and configured to indicate information that entry to the car is prohibited when the operation mode of the elevator becomes a pause mode.

* * * * *